US008135164B2

(12) United States Patent
Tanaka et al.

(10) Patent No.: US 8,135,164 B2
(45) Date of Patent: Mar. 13, 2012

(54) SPEAKER

(75) Inventors: Shoji Tanaka, Hyogo (JP); Hiroko Tsutsumi, Mie (JP); Takafumi Yuasa, Mie (JP)

(73) Assignee: Panasonic Corporation, Osaka (JP)

( * ) Notice: Subject to any disclaimer, the term of this patent is extended or adjusted under 35 U.S.C. 154(b) by 1097 days.

(21) Appl. No.: 11/965,248

(22) Filed: Dec. 27, 2007

(65) Prior Publication Data

US 2008/0159583 A1 Jul. 3, 2008

(30) Foreign Application Priority Data

Dec. 28, 2006 (JP) ..... 2006-354274

(51) Int. Cl.

| | |
|---|---|
| ***H04R 1/00*** | (2006.01) |
| ***H04R 7/00*** | (2006.01) |
| ***H04R 9/06*** | (2006.01) |
| ***H04R 11/02*** | (2006.01) |
| ***H04R 25/00*** | (2006.01) |

(52) U.S. Cl. ..... 381/423; 181/165; 181/166; 181/167; 381/184; 381/186; 381/398; 381/404; 381/424; 381/426

(58) Field of Classification Search ..... 381/423, 381/398, 404, 426; 181/165, 167
See application file for complete search history.

(56) References Cited

U.S. PATENT DOCUMENTS

| | | | | |
|---|---|---|---|---|
| 1,815,987 | A * | 7/1931 | Peterson | 181/164 |
| 2,549,139 | A * | 4/1951 | Stevens | 181/165 |
| 2,834,424 | A * | 5/1958 | Badmaieff | 181/166 |
| 2,905,260 | A * | 9/1959 | Williams | 181/167 |
| 3,834,486 | A * | 9/1974 | Tsuge et al. | 181/165 |

(Continued)

FOREIGN PATENT DOCUMENTS

| | | |
|---|---|---|
| GB | 1 450 310 | 9/1976 |

(Continued)

OTHER PUBLICATIONS

Takeo Yamamoto, "Speaker System vol. 1" First published on Jul. 15, 1977, Radio Technology Co., Ltd., Fig. 5.2, p. 145, with a partial English translation.

(Continued)

*Primary Examiner* — Elvin G Enad
*Assistant Examiner* — Christina Russell
(74) *Attorney, Agent, or Firm* — Hamre, Schumann, Mueller & Larson, P.C.

(57) ABSTRACT

A speaker of the present invention includes the following: a diaphragm that includes an inner periphery coupled to a voice coil, and a corrugation provided at the intermediate position between the inner periphery and an outer periphery; a speaker edge for supporting the outer periphery of the diaphragm; and a damping member attached to an outer peripheral part of the diaphragm outside the vicinity of an outer periphery of the corrugation. The effective vibration area of an inner peripheral part of the diaphragm inside an inner periphery of the corrugation is substantially half or less of the total effective vibration area. The damping member is configured as a damping portion by extending an overlap portion of the speaker edge overlapping with the diaphragm to the vicinity of the outer periphery of the corrugation. This configuration can suppress the vibration transmission at high frequencies to the outer peripheral part of the diaphragm outside the corrugation, allows only the inner peripheral part of the diaphragm inside the corrugation to mainly vibrate at high frequencies, and also can suppress a resonance in the outer peripheral part of the diaphragm outside the corrugation. Thus, the speaker can have both an excellent high frequency response and an excellent mid-high frequency response.

4 Claims, 6 Drawing Sheets

U.S. PATENT DOCUMENTS

| | | | | |
|---|---|---|---|---|
| 4,013,846 | A * | 3/1977 | Krawczak et al. | 381/421 |
| 4,146,756 | A * | 3/1979 | Kito et al. | 381/426 |
| 6,069,965 | A * | 5/2000 | Takewa et al. | 381/404 |
| 6,236,733 | B1 * | 5/2001 | Kato et al. | 381/423 |
| 6,305,491 | B2 * | 10/2001 | Iwasa et al. | 181/172 |
| 6,343,128 | B1 * | 1/2002 | Coffin | 381/186 |
| 6,466,676 | B2 * | 10/2002 | Coffin | 381/186 |
| 2005/0117772 | A1 * | 6/2005 | Chang | 381/404 |
| 2005/0141746 | A1 * | 6/2005 | Kobayashi et al. | 381/424 |
| 2006/0088182 | A1 * | 4/2006 | Takayama et al. | 381/398 |
| 2007/0071276 | A1 * | 3/2007 | Kudo | 381/426 |
| 2009/0052724 | A1 * | 2/2009 | Umemura | 381/398 |
| 2009/0136078 | A1 * | 5/2009 | Cobb | 381/424 |

FOREIGN PATENT DOCUMENTS

| | | |
|---|---|---|
| JP | S33-514 | 1/1958 |
| JP | S37-2017 | 2/1962 |
| JP | S53-3781 | 1/1978 |
| JP | 60-55192 | 4/1985 |
| JP | S60-55192 | 4/1985 |
| JP | 06-181599 | 6/1994 |
| JP | 7-131889 | 5/1995 |

OTHER PUBLICATIONS

Japanese Office Action mailed Mar. 8, 2011.
Japanese Office Action mailed Jun. 14, 2011.

* cited by examiner

SPEAKER

BACKGROUND OF THE INVENTION

1. Field of the Invention

The present invention relates mainly to a full-range speaker used widely in stereos, multi-channel sound reproduction devices, radios, and televisions.

2. Description of Related Art

In recent years, many speakers have been installed in homes as multi-channel home theater reproduction devices or the like become widely available. For this reason, further miniaturization and cost reduction of the speakers have been required. Therefore, instead of using the speakers in a multi-way configuration, it is desired that a single speaker be capable of reproducing low to high frequencies with high sound quality.

In general, however, it is difficult for a single speaker to reproduce low to high frequencies with excellent sound quality, and in particular to reproduce high frequencies with an excellent response. This is because the diameter of a speaker cannot be too small in order to reproduce the low frequencies to some extent, so that a reproducible frequency range at high frequencies is narrowed, and the directivity at high frequencies is particularly degraded. The difficulty in reproducing high frequencies with a single speaker with an excellent response is well known.

To solve this problem, a speaker with an improved high frequency response, such as a speaker described in FIG. 5.2, page 145 of "Speaker System Vol. 1" (Takeo Yamamoto ed., First published on Jul. 15, 1977, Radio Technology Co. Ltd.), has been proposed, and several speakers of this kind have come onto the market. FIG. 8 is a configuration diagram of a conventional speaker with an improved high frequency response described in the above-mentioned document. Hereinafter, a description will be given with reference to FIG. 8.

In FIG. 8, a field magnet 31, a damper 34, and a speaker edge 37 are attached to a frame 32, and a voice coil 33 is supported by the damper 34. A diaphragm 35 has a cone shape, and its inner periphery is coupled to the voice coil 33 and its outer periphery is supported by the speaker edge 37. A dust cap 36 is attached to an inner peripheral part of the diaphragm 35. A corrugation 35*a* is provided at the intermediate position of the diaphragm 35.

With this configuration, though the entire diaphragm 35 vibrates at low frequencies, the corrugation 35*a* functions as a mechanical filter at high frequencies. Therefore, vibrations at high frequencies are not likely to be transmitted to an outer peripheral part of the diaphragm 35 outside the corrugation 35*a*. As a result, only an inner peripheral part of the diaphragm 35 inside the corrugation 35*a* mainly vibrates, thereby improving the high frequency response.

However, in the above-described conventional speaker, the mechanical compliance of the corrugation 35*a* has to be increased significantly in order to suppress the vibration transmission at high frequencies to the outer peripheral part of the diaphragm 35 outside the corrugation 35*a*. Consequently, a mid-high frequency response is remarkably degraded because a vibration mode in an outer peripheral part of the diaphragm 35 is disturbed or a resonance occurs.

In order to prevent the degradation of the mid-high frequency response, the corrugation 35*a* must have a very small mechanical compliance. Thus, the vibration transmission at high frequencies to the outer peripheral part of the diaphragm 35 cannot be suppressed only with the corrugation 35*a*, so that the high frequency response cannot be improved.

Recently, with the progress of a diaphragm material or the like, the difficulty in expanding the reproducible frequency range at high frequencies has been gradually diminished as far as in a direction of the axis of the speaker is concerned. However, the directivity in a direction away from the axis of the speaker cannot be improved. This is because, due to the vibration transmission at high frequencies to the outer peripheral part of the diaphragm 35, high frequencies also are radiated from the outer peripheral part of the diaphragm 35, and thus the effective vibration area is not reduced.

On the other hand, there has been known a method in which a sub-cone for reproducing high frequencies is added instead of providing a corrugation on a diaphragm. However, high frequency sounds radiated from the diaphragm and high frequency sounds radiated from the sub-cone interfere with each other to cause the degradation of sound quality. Accordingly, it is desirable that the high frequency response can be improved with a single diaphragm.

SUMMARY OF THE INVENTION

Therefore, with the foregoing in mind, it is an object of the present invention to provide a speaker capable of having both an excellent high frequency response, namely a broad reproducible frequency range and especially broad directivity at high frequencies, and an excellent mid-high frequency response. Furthermore, it is an object of the present invention to provide a speaker that can suppress an increase in cost and have a unique appearance.

The speaker of the present invention includes a diaphragm that includes an inner periphery coupled to a voice coil, and a corrugation provided at the intermediate position between the inner periphery and an outer periphery, a speaker edge for supporting the outer periphery of the diaphragm, and a damping member attached to an outer peripheral part of the diaphragm outside the vicinity of the outer periphery of the corrugation. The effective vibration area of an inner peripheral part of the diaphragm inside the inner periphery of the corrugation is substantially half or less of the total effective vibration area. The damping member is configured as a damping portion by extending an overlap portion of the speaker edge overlapping with the diaphragm at the vicinity of the outer periphery of the corrugation.

According to the speaker of the present invention, the mass and the mechanical resistance of the damping portion are superposed to increase the mass and the mechanical resistance in the outer peripheral part of the diaphragm outside the corrugation. Therefore, the vibration transmission at high frequencies to the outer peripheral part of the diaphragm outside the corrugation can be suppressed. Thus, only the inner peripheral part of the diaphragm inside the corrugation mainly vibrates at high frequencies, and the effective vibration area is reduced. Accordingly, a reproducible frequency range at high frequencies is broadened, and particularly the directivity at high frequencies is broadened, resulting in an excellent high frequency response. Moreover, since a resonance and separate vibrations in the outer peripheral part of the diaphragm outside the corrugation can be suppressed at mid-high frequencies, an excellent mid-high frequency response also can be obtained.

Further, the damping member is configured as a damping portion by extending the overlap portion of the speaker edge overlapping with the diaphragm, and thus can be molded integrally with the speaker edge, so that an increase in cost can be suppressed.

DETAILED DESCRIPTION OF THE INVENTION

On the basis of the above configuration, the speaker of the present invention may have the following characteristics.

The damping portion may be provided on the surface of the diaphragm. With this configuration, it is possible not only to suppress even subtle unwanted vibrations due to the skin effect of the diaphragm material at mid-high or high frequencies, but also to provide a unique appearance due to an external contrast between the materials of the damping member and the diaphragm.

Moreover, a plurality of the corrugations may be provided, the damping portion may be provided in the outer peripheral part of the diaphragm outside the vicinity of the outer periphery of the outermost corrugation, and the effective vibration area of the inner peripheral part of the diaphragm inside the inner periphery of the innermost corrugation may be substantially half or less of the total effective vibration area. With this configuration, since a plurality of the corrugations are provided, the rigidity of the entire diaphragm is enhanced due to the rib reinforcement effect of a plurality of the corrugations. Thus, a speaker capable of performing further high power reproduction can be achieved.

Hereinafter, embodiments of the present invention will be described with reference to the drawings.

Embodiment 1

Figure 1A:
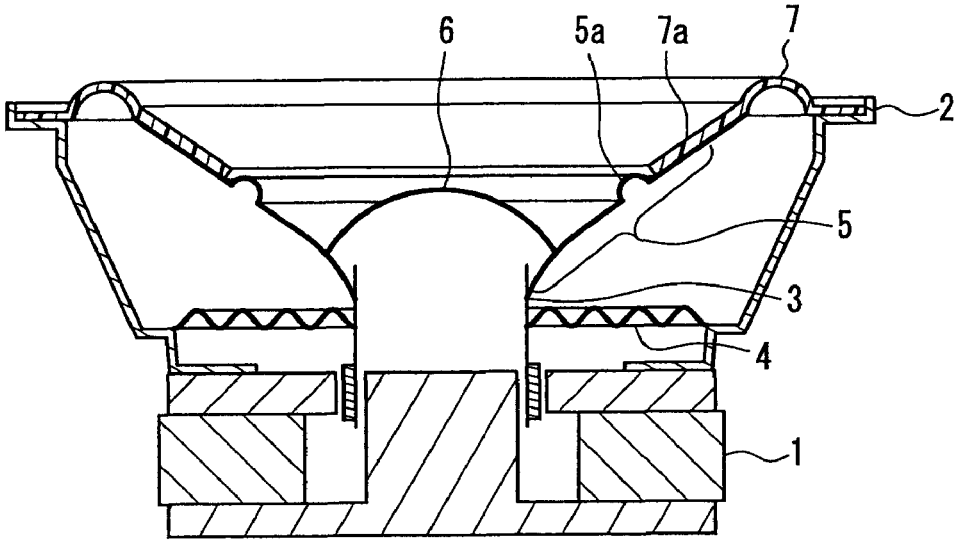
FIG. 1A is a cross sectional view showing a configuration of a speaker according to a first embodiment of the present invention.
Figure 1B:
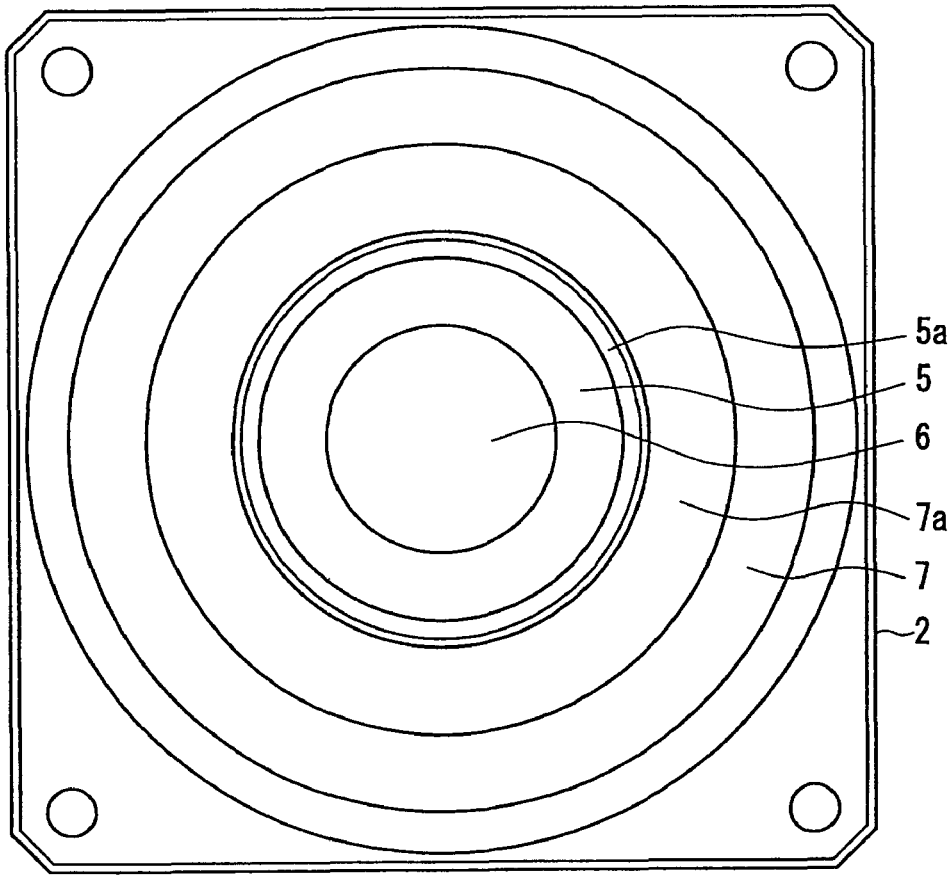
FIG. 1B is a front view showing the configuration of the speaker according to the first embodiment of the present invention.

First, the configuration of a speaker according to a first embodiment of the present invention will be described with reference to FIG. 1. FIGS. 1A and 1B are diagrams showing the configuration of the speaker according to the first embodiment of the present invention. FIG. 1A shows the cross section of the speaker and FIG. 1B shows the front appearance of the speaker.

In FIG. 1, a field magnet 1, a damper 4, and a speaker edge 7 are attached to a frame 2, and a voice coil 3 is supported by the damper 4. A diaphragm 5 has a cone shape, and its inner periphery is coupled to the voice coil 3 and its outer periphery is supported by the speaker edge 7. A dust cap 6 is attached to the vicinity of an inner peripheral part of the diaphragm 5.

A corrugation 5*a* is provided at the intermediate position of the diaphragm 5. A damping portion 7*a* that is formed as a part of the speaker edge 7 is attached to an outer peripheral part of the diaphragm 5 outside the vicinity of the outer periphery of the corrugation 5*a*. The damping portion 7*a* is formed by extending an overlap portion of the speaker edge 7 to be overlapped with the diaphragm 5 for fixing. The effective vibration area of an inner peripheral part of the diaphragm 5 inside the inner periphery of the corrugation 5*a* is substantially half or less of the total effective vibration area.

Next, specific sizes and materials of the components of the speaker according to the first embodiment will be described. The speaker has a diameter of 6.5 cm and is a so-called full-range speaker. The field magnet 1 is a general external type field magnet made of a ferrite magnet. The material of the frame 2 is an iron plate. The nominal diameter of the voice coil 3 is 19 mm. The material of the damper 4 is a cotton fabric.

The material of the diaphragm 5 is pulp having a thickness of about 0.2 mm, and the outer diameter of the diaphragm 5 is 47 mm. The cross section of the corrugation 5*a* is in the form of a circular arc of approximately one-third of the circumference, and the corrugation 5*a* is formed so as to protrude from the surface. The radius of curvature of the cross section of the corrugation 5*a* is about 1 mm. The diameter of the outer periphery of the corrugation 5*a* is 35 mm, and the diameter of the inner periphery is 32 mm. The material of the dust cap 6 is pulp having a thickness of about 0.2 mm, and the diameter of the dust cap 6 is 24 mm. The material of the speaker edge 7 is a rubber-coated fabric having a thickness of about 0.2 mm, and the diameter of the outer periphery of the rounded portion is 58 mm and the diameter of the inner periphery of the rounded portion is 48 mm. That is, the effective vibration diameter is 53 mm, and the total effective vibration area of the speaker according to the first embodiment is about 22 $cm^2$. The damping portion 7*a*, which is the overlap portion of the speaker edge 7 with the diaphragm 5, is disposed on the surface of the diaphragm 5, and the diameter of its inner periphery is 37 mm. That is, the damping portion 7*a* is located outside the outer periphery of the corrugation 5*a* and extended to the vicinity of the outer periphery of the corrugation 5*a*. The damping portion 7*a* is formed as a part of the speaker edge 7, and therefore is made of the same rubber-coated fabric.

The effective vibration area of the inner peripheral part of the diaphragm 5 inside the inner periphery of the corrugation 5*a* is about 8 $cm^2$. This is substantially half or less of the total effective vibration area.

Figure 2:
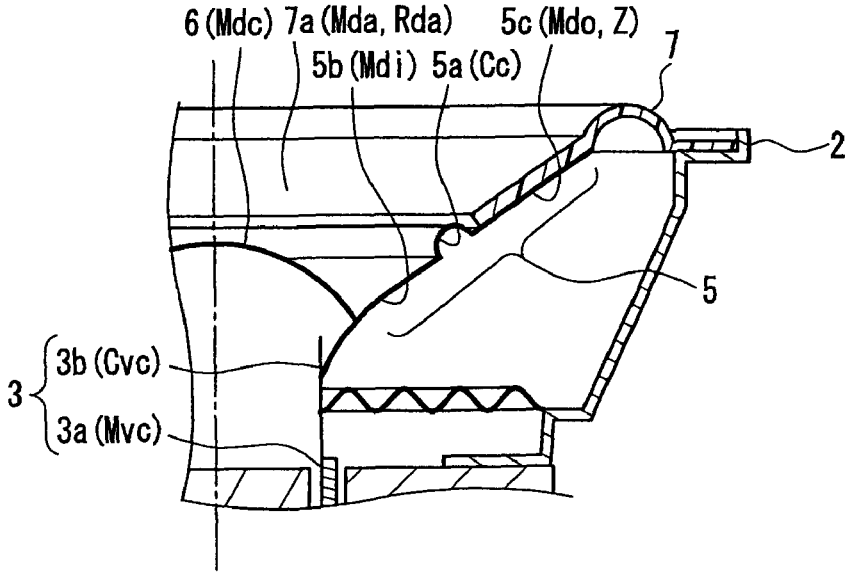
FIG. 2 is a diagram for explaining reference numerals of an electroacoustic equivalent circuit in the speaker according to the first embodiment of the present invention.
Figure 3:
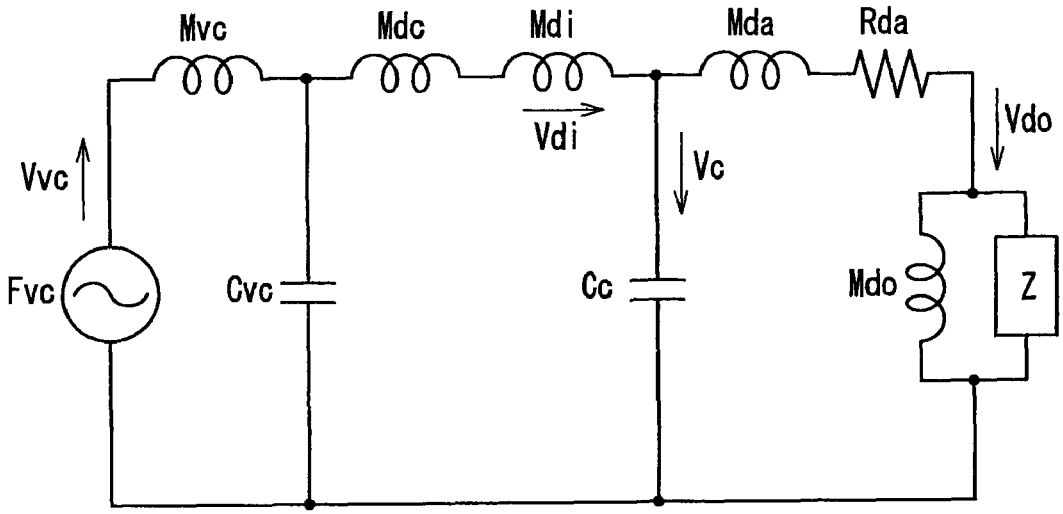
FIG. 3 is a circuit diagram of the electroacoustic equivalent circuit in the speaker according to the first embodiment of the present invention.
Figure 9:
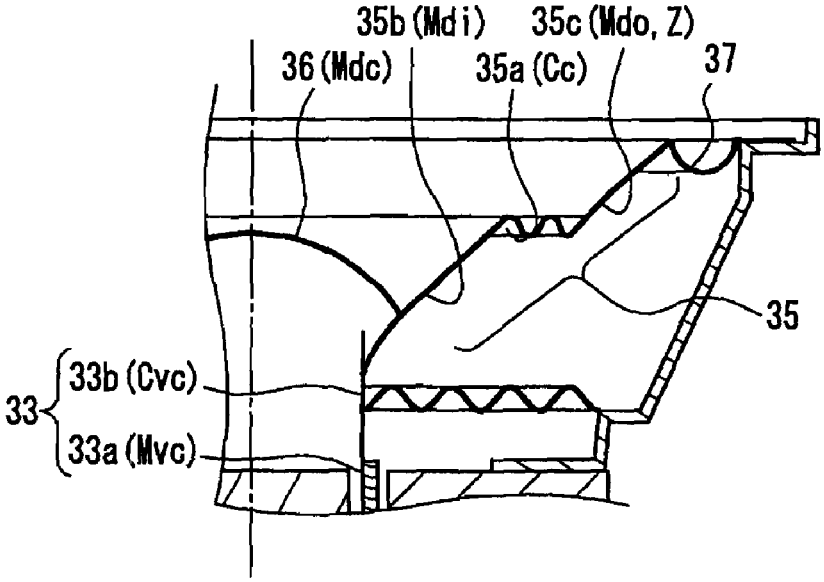
FIG. 9 PRIOR ART
FIG. 9 is a diagram for explaining reference numerals of an electroacoustic equivalent circuit in a conventional speaker.

Hereinafter, the principles, actions, and effects of the speaker according to the first embodiment configured as described above will be described with reference to FIGS. 2, 3, 9, and 10. FIG. 2 is a diagram for explaining reference numerals of an electroacoustic equivalent circuit in the speaker according to the first embodiment, and FIG. 3 is a circuit diagram of the electroacoustic equivalent circuit. FIG. 9 is a diagram for explaining reference numerals of an electroacoustic equivalent circuit in a conventional speaker, and FIG. 10 is a circuit diagram of the electroacoustic equivalent circuit.

Figure 10:
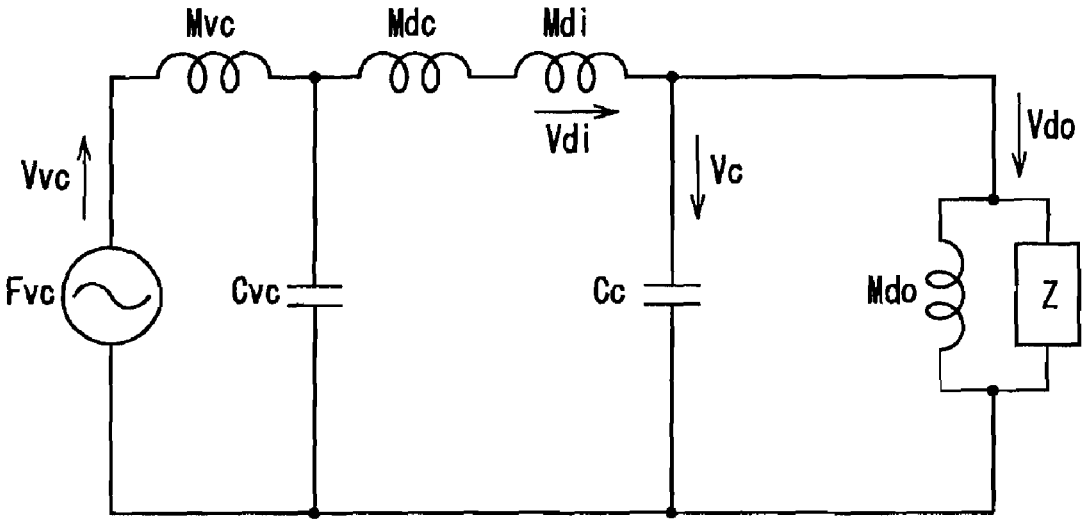
FIG. 10 PRIOR ART
FIG. 10 is a circuit diagram of the electroacoustic equivalent circuit in the conventional speaker.

First, problems of the conventional speaker will be analyzed in terms of the principles with reference to FIGS. 9 and 10. In FIGS. 9 and 10, Fvc denotes the driving force of a voice coil 33, and Vvc denotes the vibration speed of the voice coil 33. Mvc denotes the equivalent vibration mass of a voice coil winding portion 33*a*, and Cvc denotes the mechanical compliance of a voice coil bobbin portion 33*b*. Mdc denotes the equivalent vibration mass of a dust cap 36. Mdi denotes the equivalent vibration mass on an inner peripheral part 35*b* of a diaphragm 35 inside a corrugation 35*a*, and Vdi denotes the vibration speed of the inner peripheral part 35*b*. In general, Cvc is small and may be virtually ignored except at super-high frequencies.

Cc denotes the mechanical compliance of the corrugation 35*a*. Vc denotes the vibration speed that is absorbed by the corrugation 35*a*. Mdo denotes the equivalent vibration mass on an outer peripheral part 35*c* of the diaphragm 35 outside the corrugation 35*a*, Z denotes an equivalent mechanical impedance that appears when separate vibrations occur in the outer peripheral part 35*c*, and Vdo denotes the vibration speed of the outer peripheral part 35*c*.

If the mechanical compliance Cc is increased, i.e., the corrugation 35*a* is softened, the vibration speed Vc increases and the vibration speed Vdo decreases. Therefore, the vibration transmission at high frequencies to the outer peripheral part 35*c* of the diaphragm 35 can be suppressed.

However, the Q of a resonance circuit formed of the mechanical compliance Cc and the equivalent vibration mass Mdo is increased as the mechanical compliance Cc becomes larger. Thus, the vibration speed Vdo is increased conversely with such a resonance frequency. In other words, the outer peripheral part 35*c* of the diaphragm 35 will produce a large resonance at mid-high frequencies.

Next, the principles, actions, and effects of the speaker according to the first embodiment will be described with reference to FIGS. 2 and 3. In FIGS. 2 and 3, Fvc denotes the driving force of the voice coil 3, and Vvc denotes the vibration speed of the voice coil 3. Mvc denotes the equivalent vibration mass of a voice coil wiring portion 3*a*, and Cvc denotes the mechanical compliance of a voice coil bobbin portion 3*b*. Mdc denotes the equivalent vibration mass of the dust cap 6. Mdi denotes the equivalent vibration mass on an inner peripheral part 5*b* of the diaphragm 5 inside the corrugation 5*a*, and Vdi denotes the vibration speed of the inner peripheral part 5*b*.

Cc denotes the mechanical compliance of the corrugation 5*a*. Vc denotes the vibration speed that is absorbed by the corrugation 5*a*. Mdo denotes the equivalent vibration mass on an outer peripheral part 5*c* of the diaphragm 5 outside the corrugation 5*a*, Z denotes an equivalent mechanical impedance that appears when separate vibrations occur in the outer peripheral part 5*c*, and Vdo denotes the vibration speed of the outer peripheral part 5*c*. Mda denotes the equivalent vibration mass of the damping portion 7*a*, and Rda denotes the mechanical resistance, in other words, viscoelastic resistance of the damping portion 7*a*.

As can be seen from the electroacoustic equivalent circuit in FIG. 3, since the equivalent vibration mass Mda and the mechanical resistance Rda are inserted in series into the equivalent vibration mass Mdo, the vibration speed Vdo can be reduced sufficiently without increasing the mechanical compliance Cc. That is, even if the corrugation 5*a* is not softened, the vibration transmission at high frequencies to the outer peripheral part 5*c* of the diaphragm 5 can be suppressed by utilizing the equivalent mass Mda and the mechanical resistance Rda of the damping portion 7*a*. In other words, it can be said that the damping portion 7*a* damps the outer peripheral part 5*c* of the diaphragm 5 in terms of both mass and mechanical resistance.

Furthermore, since the Q of a resonance circuit formed of the mechanical compliance Cc, the equivalent vibration mass Mda, the mechanical resistance Rda, and the equivalent vibration mass Mdo are reduced due to the mechanical resistance Rda, the outer peripheral part 5*c* of the diaphragm 5 is less likely to resonate at mid-high frequencies. The mechanical resistance Rda is also inserted in series into the equivalent mechanical impedance Z, so that the separate vibrations in the outer peripheral part 5*c* of the diaphragm 5 can be also suppressed.

As described above, according to the configuration of the first embodiment, the vibration transmission at high frequencies to the outer peripheral part 5*c* of the diaphragm 5 outside the corrugation 5*a* is suppressed, and only the inner peripheral part 5*b* of the diaphragm 5 inside the corrugation 5*a* mainly vibrates at high frequencies, thus reducing the effective vibration area. Therefore, a reproducible frequency range at high frequencies is broadened, and particularly the directivity at high frequencies is broadened, resulting in an excellent high frequency response. Moreover, since a resonance and separate vibrations in the outer peripheral part 5*c* of the diaphragm 5 outside the corrugation 5*a* are suppressed at mid-high frequencies, an excellent mid-high frequency response also can be obtained. Further, since the damping portion 7*a* is attached to the surface of the diaphragm 5, it is possible to suppress even subtle unwanted vibrations due to the skin effect of the diaphragm material at mid-high or high frequencies.

There are desirable relationships among the diaphragm 5, the corrugation 5*a*, and the damping portion 7*a* in order to exhibit the above-mentioned effects of the present invention. When the outer periphery of the corrugation 5*a* and the inner periphery of the damping portion 7*a* are too far apart from each other, the damping effect of the damping portion 7*a* on the outer peripheral part 5*c* of the diaphragm 5 at mid-high frequencies is reduced. Accordingly, it is desirable that the inner periphery of the damping portion 7*a* be in the vicinity of the outer periphery of the corrugation 5*a*. Further, in order to obtain a sufficient damping effect of the damping portion 7*a*, it is desirable that the area of the damping portion 7*a* be at least half of the area of the diaphragm 5 outside the outer periphery of the corrugation 5*a*.

Further, it is desirable that the damping portion 7*a* be located on the outer peripheral part of the diaphragm 5 outside the outer periphery of the corrugation 5*a*. This is because vibrations in the inner peripheral part 5*b* of the diaphragm 5 at high frequencies will be suppressed, if the damping portion 7*a* overlaps the inner peripheral part 5*b* of the diaphragm 5 over the corrugation 5*a*. Moreover, if the damping portion 7*a* overlaps the corrugation 5*a*, the mass-productivity of the speaker will be degraded, leading to a significant increase in cost.

When the diameter of the corrugation 5*a* is not reduced to some extent or more with respect to the effective vibration diameter that defines the total effective vibration area, the effect of improving the high frequency response is reduced due to a decrease in the effect of reducing the effective vibration area at high frequencies. In addition, the effect of suppressing a resonance in the outer peripheral part 5*c* of the diaphragm 5 by the damping portion 7*a* also is reduced because a sufficient area for the damping portion 7*a* cannot be ensured. Accordingly, the effective vibration area of the inner peripheral part of the diaphragm 5 inside the inner periphery of the corrugation 5*a* is set to be substantially half or less of the total effective vibration area, thereby providing sufficient effects for the above two problems.

Since the damping portion 7*a* is attached to the diaphragm 5, the total effective vibration mass is increased, and the output sound pressure level of the speaker tends to be low. However, if the diaphragm 5 is designed to be light-weight in advance, i.e., if the thickness of the material of the diaphragm 5 is reduced for example, it is possible to prevent such a decrease in the sound pressure due to the damping portion 7*a*.

Figure 4:
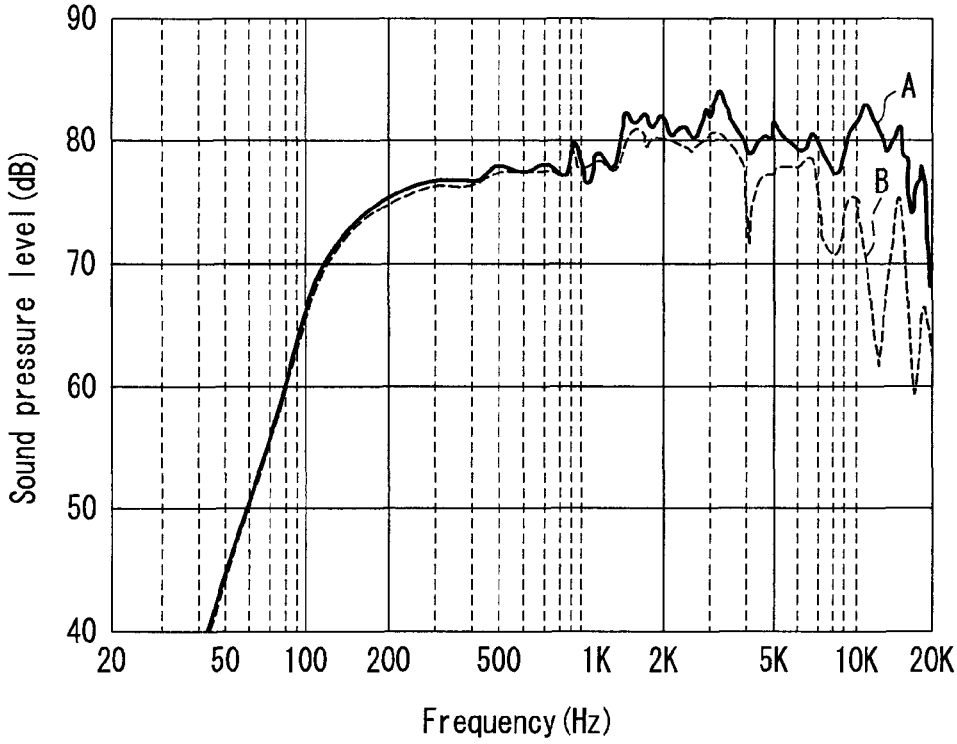
FIG. 4 is a diagram illustrating the frequency characteristics of a conventional speaker.
Figure 5:
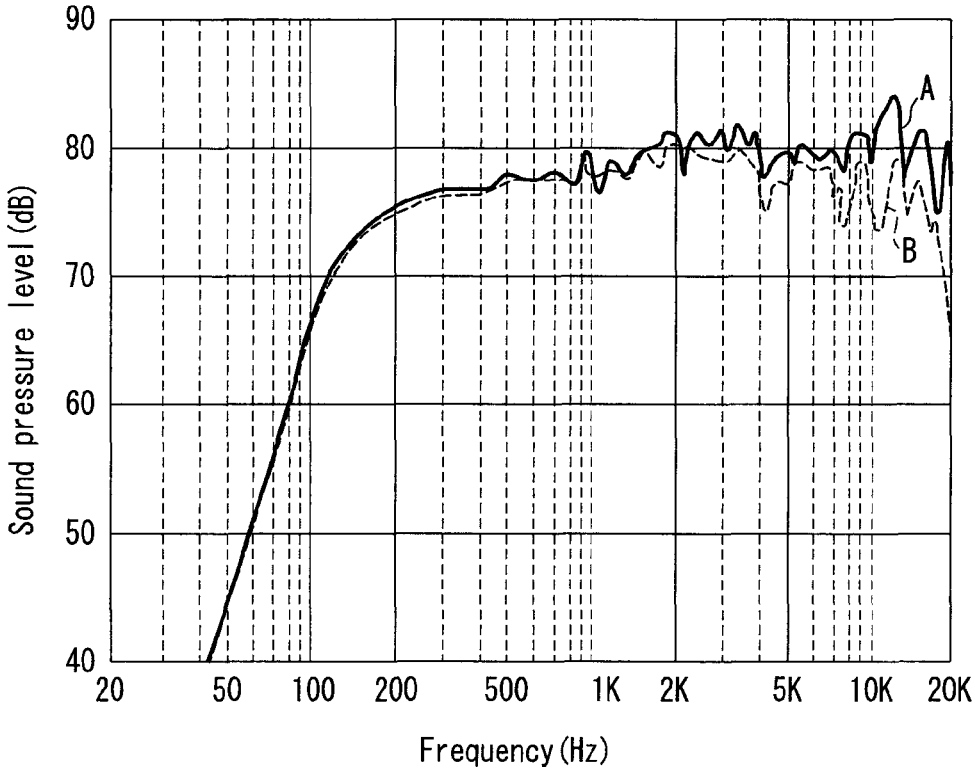
FIG. 5 is a diagram illustrating the frequency characteristics of a speaker according to a first embodiment of the present invention.

An effect obtained by providing the damping portion 7*a* in the above configuration will be described with reference to FIGS. 4 and 5. FIG. 4 is a diagram showing the frequency characteristics of a conventional speaker, and FIG. 5 is a diagram showing the frequency characteristics of the speaker according to the first embodiment. Similarly to the speaker according to the first embodiment, the conventional speaker whose frequency characteristics are shown in FIG. 4 also has a diameter of 6.5 cm. The conventional speaker only differs from the speaker of the first embodiment in the structures of a diaphragm and a speaker edge. The diaphragm of this conventional speaker is not provided with a corrugation, is made of pulp having a thickness of about 0.3 mm, and has an ordinary cone shape. An overlap portion of the speaker edge has a width of 2 mm and is attached to the backside of the diaphragm.

In FIGS. 4 and 5, a curve in a solid line A indicates frequency characteristics of sound pressure at a distance of 2 m in a direction of the axis when each speaker is enclosed in a small cabinet, and a power of 1 W is applied. A curve in a dotted line B indicates directivity at a distance of 2 m in a direction tilted from the axis by 30°.

As can be seen from FIG. 4, in the conventional speaker, though the reproducible frequency range extends to little less than 20 kHz on the axis, the 30° directivity is attenuated considerably at high frequencies, and thus the directivity at high frequencies is poor. In contrast, as can be seen from FIG. 5, the reproducible frequency range of the speaker according to the first embodiment extends to 20 kHz, and the attenuation of the 30° directivity is extremely small, so that the directivity at high frequencies is very excellent.

Comparing FIGS. 4 and 5, a disturbance in response at 1.5 kHz to 4 kHz is smaller in the speaker according to the first embodiment than in the conventional speaker, and even the mid-high frequency response can be improved.

Moreover, in the speaker according to the first embodiment, it is not necessary to provide a damping member independently because the damping portion 7*a* is formed by extending the overlap portion of the speaker edge 7. This can minimize an increase in cost. The damping portion 7*a* extended to the vicinity of the outer periphery of the corrugation 5*a* had been conventionally discarded during the process of making a hole in manufacturing of the speaker edge. Therefore, no extra material cost is required for the extended damping portion 7*a*.

Since the damping portion 7*a* is provided on the surface of the diaphragm 5, it is possible to suppress even subtle unwanted vibrations due to the skin effect of the diaphragm material at mid-high or high frequencies.

Further, the speaker can have a distinctive and beautiful exterior design as never before. That is, the inner peripheral part of the diaphragm 5 inside the corrugation 5*a* looks like a tweeter, while the damping portion 7*a* located on the outer peripheral part outside the corrugation 5*a* looks like a woofer. Thus, this exterior design is suitable for visually representing an image of the effect of a mechanical two-way of the speaker of the present invention. Moreover, the first embodiment does not require any independent damping member, and therefore can reduce the types of materials that can be seen visually from the front, and facilitate the exterior design process.

Though the material of the speaker edge 7 is a rubber-coated fabric in the above configuration, various kinds of rubbers, a urethane foam, an elastomer, or the like also can be used. The effect of improving the mid-high frequency response is increased with a material having larger internal loss. However, a certain effect can be obtained even by an ordinary fabric material for the speaker edge, since it contains a phenol resin and rubber components. The smaller the thickness of the diaphragm 5 is, the higher the effect of reducing the effective vibration area at high frequencies becomes, since a mass ratio per unit area of the diaphragm 5 on the inner peripheral part and the outer peripheral part with respect to the corrugation 5*a* becomes larger.

In the above configuration, the inner periphery of the damping portion 7*a* is extended to a position that is 1 mm away from the outer periphery of the corrugation 5*a*. This space can be broadened further. However, if this space is broadened excessively, the damping effect of the damping portion 7*a* is reduced too much. Thus, it is desirable that the space be within a range where the area of the damping portion 7*a* is at least half of the area of the diaphragm 5 outside the outer periphery of the corrugation 5*a*.

On the other hand, if this space is too narrow, the damping portion 7*a* may be overlapped with the corrugation 5 due to misalignment between the diaphragm 5 and the speaker edge 7 in manufacturing of the diaphragm having a speaker edge, or a difference in gaps on the left and right sides becomes large, resulting in a poor appearance. Accordingly, a space of 1 mm is not too broad.

Though the diaphragm 5 has a cone shape in the above configuration, it may have a dome shape as will be described later in a third embodiment, a reverse truncated cone shape, a flat shape, or any other shapes. Further, though the diaphragm 5 is circular in the above configuration, it may be square, rectangular, elliptic, or any other shapes. Though the corrugation 5*a* is circular, it may be square, rectangular, elliptic, or any other shapes. That is, the shapes of the diaphragm and the corrugation do not have to be the same.

In the above configuration, the corrugation has a circular arc cross section and is formed so as to protrude from the surface. However, it is needless to say that the cross section may have a stepped shape as will be described later in a second embodiment, a corrugated shape, a concave circular arc shape, or any other shapes.

Further, though the number of corrugations in the above configuration is one, the speaker can be provided with a plurality of corrugations. In this case, when the damping member is disposed in the outer peripheral part of the diaphragm outside the vicinity of the outer periphery of the outermost corrugation, it is possible to avoid an increase in cost resulting from reduced mass-productivity. When the effective vibration area of the inner peripheral part of the diaphragm inside the inner periphery of the innermost corrugation is set to be substantially half or less of the total effective vibration area, the effect of reducing the effective vibration area at high frequencies can be ensured. When the speaker is provided with a plurality of the corrugations, the rigidity of the entire diaphragm is enhanced due to the rib reinforcement effect of a plurality of the corrugations. Thus, such a speaker can achieve further high power reproduction.

Though pulp is used as the material of the diaphragm 5 in the above configuration, it is needless to say that various materials such as metal, resin-molded products, and resin films can be used. For example, when the diaphragm 5 is a resin-molded product, the effect of suppressing the vibration transmission at high frequencies further can be improved by molding the outer peripheral part 5*c* thicker than the inner peripheral part 5*b* of the diaphragm 5 so as to increase the equivalent vibration mass Mdo in FIG. 3. Since the thickness of the corrugation 5*a* can be made smaller than that of the diaphragm 5, the degree of flexibility in designing the machine compliance Cc is enhanced in FIG. 3.

Embodiment 2

Figure 6:
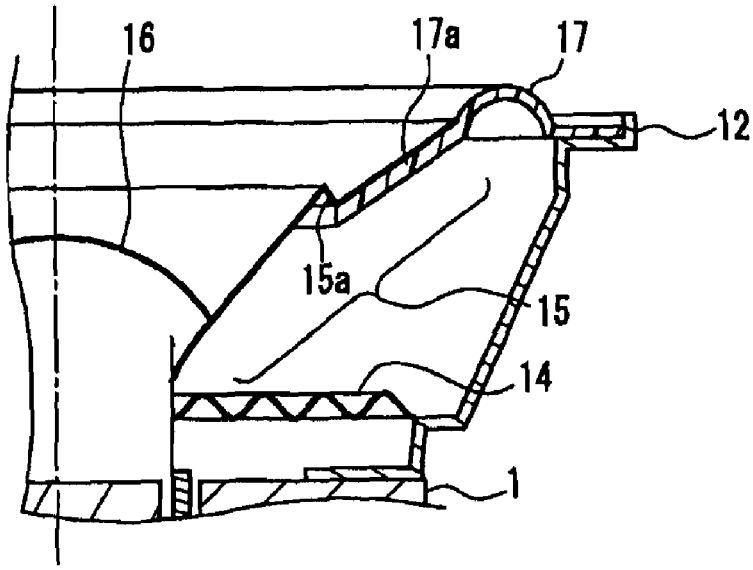
FIG. 6 is a cross sectional view showing a configuration of a speaker according to a second embodiment of the present invention.

Next, a speaker according to a second embodiment of the present invention will be described with reference to FIG. 6. FIG. 6 is a cross sectional view showing the main portion of the configuration of the speaker according to the second embodiment. In FIG. 6, a frame 12, a voice coil, a damper 14, and a dust cap 16 are identical to those in the first embodiment, and the description will not be repeated.

The second embodiment is different from the first embodiment in a diaphragm 15, a corrugation 15*a*, a speaker edge 17, and a damping potion 17*a* for the diaphragm 15. The material of the diaphragm 15 is pulp having a thickness of about 0.3 mm. Though the inner and outer diameters of the diaphragm 15 are the same as those in the first embodiment, the corrugation 15*a* has a stepped shape. The diameter of the inner periphery of the corrugation 15*a* is 36 mm, and the diameter of the outer periphery is 38 mm, and the height of the step is 0.7 mm.

The material of the speaker edge 17 is a foam rubber having a thickness of 0.5 mm. The size of a rounded portion of the speaker edge 17 is the same as that in the first embodiment, namely the diameter of the outer periphery is 58 mm and the diameter of the inner periphery is 48 mm. That is, the effective vibration diameter is 53 mm and, similarly to the speaker according to the first embodiment, the total effective vibration area is about 22 $cm^2$.

The damping portion 17*a* for the diaphragm 15 is provided on the backside of the diaphragm 15, and the diameter of the inner periphery is 39 mm. That is, similarly to the first embodiment, the damping portion 17*a* is extended to the vicinity of the outer periphery of the corrugation 15*a*. As same as the speaker edge 17, the material of the damping portion 17*a* is a foam-rubber fabric. The effective vibration area of the inner peripheral part of the diaphragm 15 inside the corrugation 15*a* is about 10 $cm^2$, which is substantially half or less of the total effective vibration area.

With this configuration, the speaker of the second embodiment has the same function and effects as those of the speaker of the first embodiment. That is, the damping portion 17*a* functions as a damping member, and thus the same effects can be obtained as described in the first embodiment. Like the first embodiment, it is not necessary to provide a damping member independently in the speaker according to the second embodiment. This can minimize an increase in cost. In the second embodiment, since the damping portion 17*a* is disposed on the backside of the diaphragm 15, the damping portion 17*a* cannot be seen from the front of the speaker. Therefore, a clean-cut exterior design can be obtained.

Embodiment 3

Figure 7:
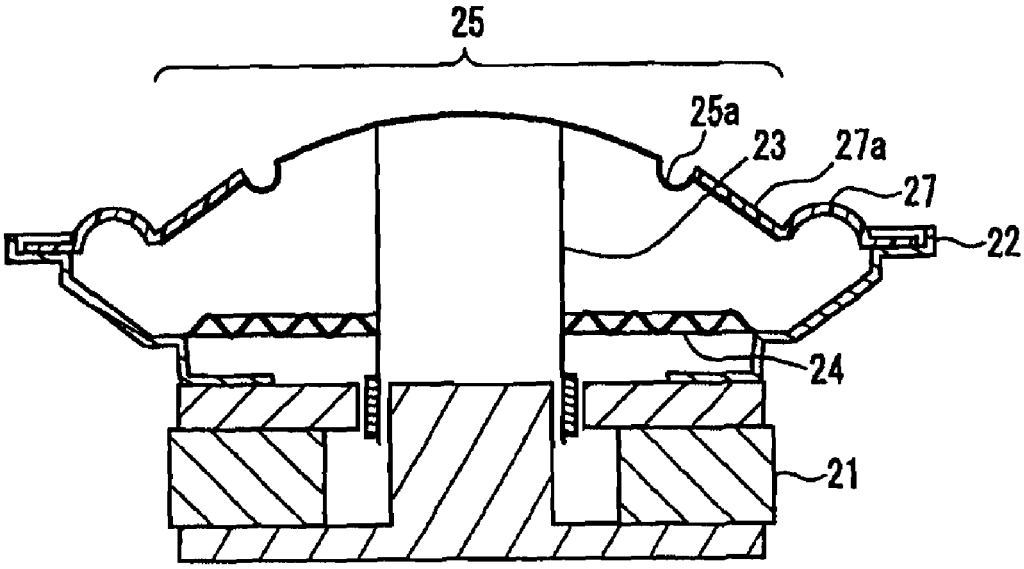
FIG. 7 is a cross sectional view showing a configuration of a speaker according to a third embodiment of the present invention.
Figure 8:
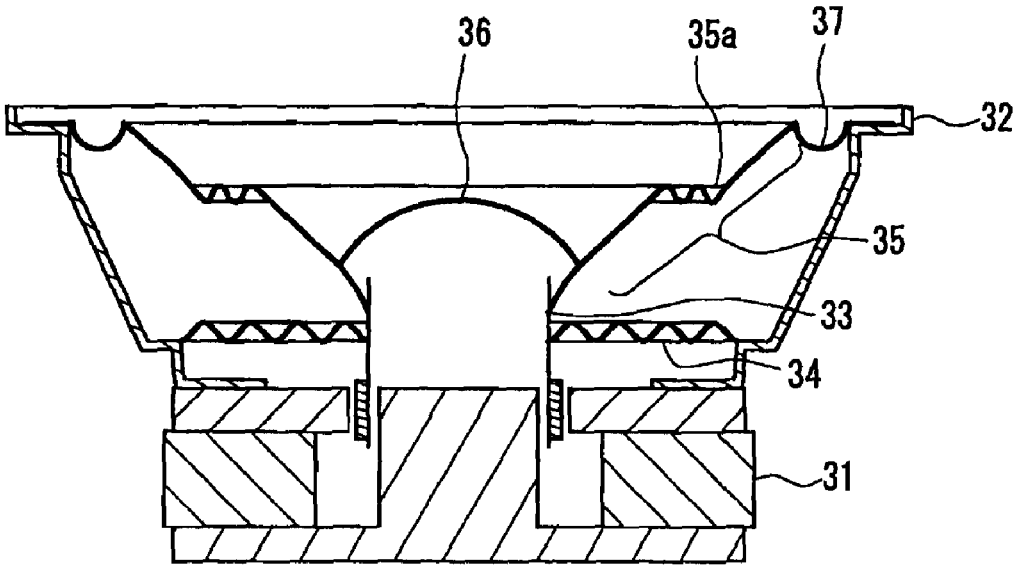
FIG. 8 PRIOR ART
FIG. 8 is a cross sectional view showing a configuration of a conventional speaker.

FIG. 7 shows the configuration of a speaker according to a third embodiment of the present invention. In FIG. 7, the speaker has a diameter of 6.5 cm and is a dome-shaped full-range speaker. The configurations of a field magnet 21, a frame 22, a voice coil 23, and a damper 24 are similar to those in the first embodiment, and the description will not be repeated.

In the third embodiment, the material of a diaphragm 25 is aluminum having a thickness of 0.1 mm. The diaphragm 25 has an outer diameter of 46 mm and has a dome shape. The cross section of a corrugation 25*a* is substantially in the form of a ⅓ concave circular arc, and the radius of curvature of the cross section is about 0.7 mm. The diameter of the outer periphery of the corrugation 25*a* is 35 mm, and the diameter of the inner periphery is 33 mm.

The material of a speaker edge 27 is a foam rubber having a thickness of 0.5 mm. The diameter of the outer periphery of a rounded portion of the speaker edge 27 is 58 mm and the diameter of the inner periphery of the rounded portion is 48 mm. That is, the effective vibration diameter is 53 mm and the total effective vibration area of the speaker of the third embodiment is about 22 $cm^2$. A damping portion 27*a*, which is an overlap portion of the speaker edge 27 with the diaphragm 25, is disposed on the surface of the diaphragm 25, and the diameter of its inner periphery is 36 mm. That is, the damping portion 27*a* is extended to the vicinity of the outer periphery of the corrugation 25*a* and is used as a damping member. The same as the speaker edge 27, the material of the damping portion 27*a* is a foam rubber. The effective vibration area of the inner peripheral part of the diaphragm 25 inside the inner periphery of the corrugation 25*a* is about 8.5 $cm^2$, which is set to be substantially half or less of the total effective vibration area.

With this configuration, the speaker of the third embodiment has completely the same function and effects as the speaker of the first embodiment. That is, the damping portion 27*a* functions as a damping member, and thus the same effects can be obtained as described in the first embodiment. Like the first embodiment, it is not necessary to provide a damping member individually in the speaker according to the third embodiment. This can minimize an increase in cost.

As described above, according to the speaker of the present invention, a reproducible frequency range at high frequencies is broadened, and particularly the directivity at high frequencies is broadened, so that an excellent high frequency response can be obtained. Moreover, an excellent mid-high frequency response also can be obtained. Accordingly, the speaker of the present invention is useful for sound reproduction in a variety of electronic equipment, including not only ordinary two-channel stereo sound reproduction devices and multi-channel sound reproduction devices, but also TV sound reproduction devices, car audio reproduction devices, sound reproduction devices built into personal computers, and portable sound reproduction devices.

The invention may be embodied in other forms without departing from the sprit of essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A speaker comprising:

a diaphragm having an inner periphery coupled to a voice coil, and a corrugation provided at an intermediate position between the inner periphery and an outer periphery;

a speaker edge for supporting the outer periphery of the diaphragm; and a damping member attached to an outer part of the diaphragm so as to cover a region between an outer periphery of the corrugation and an outer periphery of the diaphragm, wherein an effective vibration area of an inner part of the diaphragm inside an inner periphery of the corrugation is substantially half or less of a total effective vibration area, and the damping member is configured as a damping portion formed by a portion of the speaker edge, and overlapped with the diaphragm so as to extend to the outer periphery of the corrugation.

2. The speaker according to claim 1, wherein the damping portion is provided on a front surface of the diaphragm.

3. The speaker according to claim 2, wherein a plurality of the corrugations are provided, the damping portion is provided in the outer part of the diaphragm outside a vicinity of an outer periphery of an outermost corrugation, and the effective vibration area of the inner part of the diaphragm inside an inner periphery of an innermost corrugation is substantially half or less of the total effective vibration area.

4. The speaker according to claim 1, wherein a plurality of the corrugations are provided, the damping portion is provided in the outer part of the diaphragm outside a vicinity of an outer periphery of an outermost corrugation, and the effective vibration area of the inner part of the diaphragm inside an inner periphery of an innermost corrugation is substantially half or less of the total effective vibration area.

* * * * *